US005575074A

United States Patent [19]

Cottongim et al.

[11] Patent Number: 5,575,074

[45] Date of Patent: Nov. 19, 1996

[54] SPEED SQUARE

[76] Inventors: Craig Cottongim, 1058A Heritage Hill Dr., Naperville, Ill. 60563; Ronald J. Scheidelman, 4914 Columbia Ave., Lisle, Ill. 60532-2202; Darrell A. Martin, P.O. Box 1118, Wheaton, Ill. 60189-1118

[21] Appl. No.: 395,757

[22] Filed: Feb. 28, 1995

[51] Int. Cl.[6] ..... B25F 1/00; B25B 13/48; B43L 13/00

[52] U.S. Cl. ..... 33/474; D8/26; 81/180.1

[58] Field of Search ..... 33/474, 479, 484, 33/485; 81/180.1, 181, 182, 488, 900, DIG. 1; D8/21, 26, 28

[56] References Cited

U.S. PATENT DOCUMENTS

| | | | |
|---|---|---|---|
| D. 197,915 | 4/1964 | Ayars | D8/26 |
| D. 320,725 | 10/1991 | Rubesh | D8/21 |
| D. 321,460 | 11/1991 | Tiefenthal | D8/26 |
| D. 347,370 | 5/1994 | Runevitch | D8/26 |
| 363,331 | 5/1887 | Hammer | 33/485 |
| 506,832 | 10/1893 | Schofield | D8/26 |
| 614,144 | 11/1898 | Thompson . | |
| 1,084,973 | 1/1914 | Stanwood et al. . | |
| 1,135,259 | 4/1915 | Cokely . | |
| 1,315,333 | 9/1919 | Roads . | |
| 2,421,665 | 6/1947 | Umbdenstock | D8/21 |
| 2,654,954 | 10/1953 | Lawrence . | |
| 3,456,353 | 7/1969 | Iams . | |
| 4,037,275 | 7/1977 | Schor | D8/26 |
| 4,125,490 | 11/1978 | Hettinga . | |
| 4,404,753 | 9/1983 | Klok . | |
| 4,406,187 | 9/1983 | Osborne, Jr. | 81/108.1 |
| 4,513,510 | 4/1985 | Swanson . | |
| 4,573,276 | 3/1986 | Torczon . | |
| 4,742,619 | 5/1988 | Swanson . | |
| 4,773,163 | 9/1988 | Wolford . | |
| 5,170,568 | 12/1992 | Wright . | |

OTHER PUBLICATIONS

*The Swanson Speed Square: Swanson's Blue Book of Rafter Lengths & Roof Construction* published by the Swanson Tool Co., 1010 Lambrecht Rd., Frankfort, IL 60523, item #00010, 1991 (no date).

Strandring, P. M.; Moon, J. R. "Application of Rotary Forging to Consolidation of Metal Powders," *Powder Metallurgy*, vol. 35 No. 3, 1992, pp. 193–202 (no month).

Chen, Guiyun; Xie, Zanhua; Zang, Zhixin; Zhang, Yongchang. "Structures and properties of rapidly solidified P/M Al–Si–Cu–Mg alloy," *Fenmo Yejin Jishu/P–M Technology*, vol. 12 No. 1, Feb. 20, 1994, pp. 3–7.

*Primary Examiner*—Christopher W. Fulton
*Attorney, Agent, or Firm*—John G. Premo

[57] ABSTRACT

A combination marking tool and wrench which comprises a triangular speed square having a T-bar extending substantially along the length of an outer edge of one of the sides of the triangular speed square. The T-bar has at least one nut engaging shaped opening located on its face and projecting outwardly away from the T square and near an end of said bar. Also shown is a speed square which contains additional marking scales and speed squares which are brightly marked so as to be easily found as well as speed squares easily identifiable via alphanumeric identification codes. More useful marking scales, including metric, and the rearrangement thereof provide greater speed, accuracy, convenience and utility for the speed square.

5 Claims, 2 Drawing Sheets

FIG.1
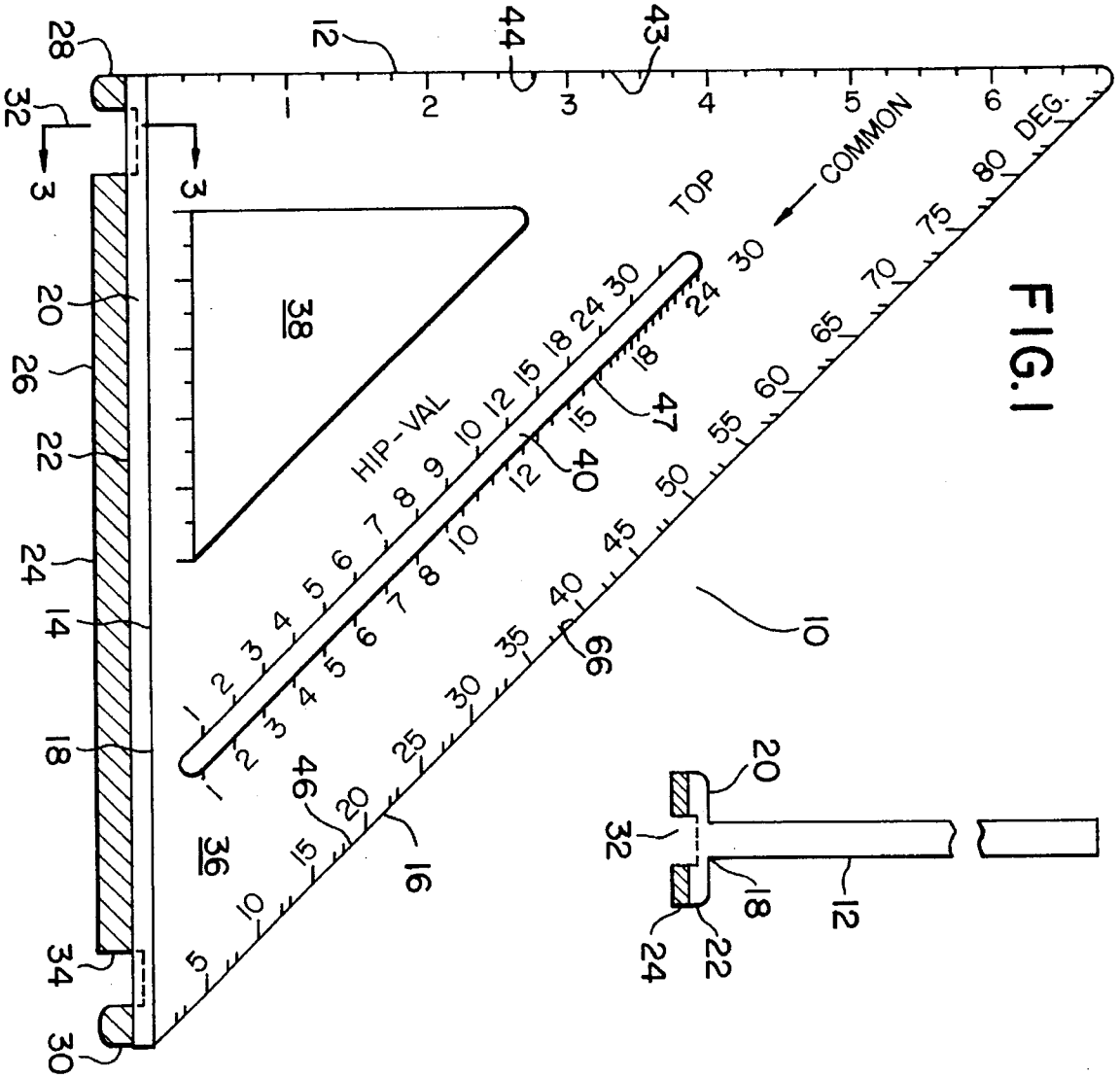
FIG.3
FIG.2
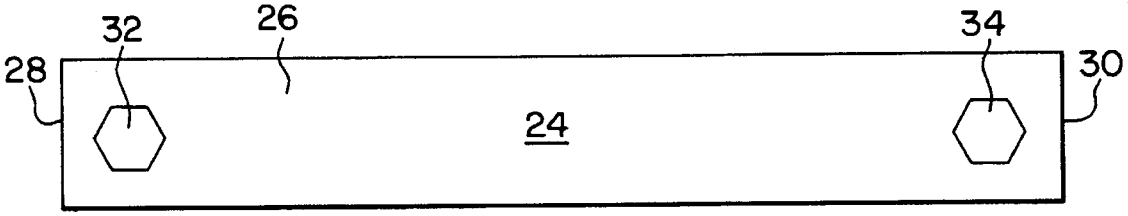

SPEED SQUARE

FIELD OF THE INVENTION

The invention relates to a combination hand tool with further unique features.

INTRODUCTION

Roof framers and many other trades typically make daily use of triangular shaped framing squares known as speed squares. These trades include:

1. Concrete formers of footing and foundation,
2. Trim carpenters,
3. Cabinet and closet makers,
4. Building siders of vinyl, aluminum, and wood,
5. Garage door installers,
6. Formers of concrete sidewalks, driveways, and stoops,
7. Makers of cedar decks, sun rooms, and gazebos,
8. Remodelers and handymen,
9. Bricklayers,
10. Formers of concrete curbs,
11. Master stair builders (e.g., spiral oak stairs),
12. Teachers and students of shop class in schools, and
13. General contractors.

These marking devices and their uses are described in detail in the booklet entitled: *The Swanson Speed Square: Swanson's Blue Book of Rafter Lengths & Roof Construction*, published by the Swanson Tool Co., 1010 Lambrecht Rd., Frankfort, Ill. 60523, item #00010, 1991. The contents of this booklet are incorporated herein by reference. The primary reason for the popularity of speed squares is that they are small and lightweight making them suitable for replacing bulky framing squares and T-squares. A very common use for speed squares is to square scribe building materials such as lumber, roofing, and the like.

These tradesmen use speed squares to measure and mark the material then cut it as marked with a portable circular saw variously called worm drive, sidewinder, and contractor saw. These saws require frequent replacement of the blades. The blade is mounted to the saw by means of a threaded shaft that is adapted to mate with a hole in the center of the blade. The blade is secured over the threaded shaft by a nut that is usually a ½ or 9/16 inch nut. To allow removal and replacement of these nuts, saw manufacturers supply a small rectangular steel plate having a wrench shaped opening on one end that corresponds in size to the dimension of the nut used to hold the saw blade onto the saw.

Tradesmen carry tools that they use daily on their person on belts or in pouches. Both because the small wrench for the saw is not used daily and because it is easily lost, the tradesman does not carry it. Further the wrench is not typically secured to the cord of the saw because it is common knowledge that the cord is often cut by abuse, misuse or overuse. In fact the wrench is not commonly secured anywhere leaving it susceptible to loss. Worse, the tradesman may never see the wrench that was originally sold with the saw either because it is common practice to separate it from the box and manual or because the saw was purchased used, without its wrench.

The effect of all this is to create a temporary crisis when the wrench is needed. Typically the tradesman responds by using whichever available tool will accomplish loosening and retightening the nut in question in the changing of the saw blade. In fact, none may be available. This is wasteful of both manpower and materials and increases the likelihood of both injury to the tradesman and damage to the saw. Working in situations where his auxiliary tools are relatively inaccessible exacerbates the problem. Such situations include both working high in a several-story building and when the tradesman must endure the elements to reach a helpful tool. With the maneuvering of machines and material and with men facing deadlines, with the best of intentions a small wrench for a saw is likely lost and unavailable when needed. All of the above problems are simply solved by the incorporation of the appropriate wrenches in a tool that is always available. Also, since tradesmen carry a number of tools to the job site, the fewer the number of tools necessary to complete a piece of work the more productive is the tradesman. Candidate tools for combining with the wrenches are: speed square, hammer, measuring tape, and snap line. The speed square is the optimal tool for incorporation of these wrenches. The reasons are as follows:

1. As pointed out above, the speed square is used daily almost universally among tradesmen (as are the other candidate tools),
2. Among the candidate tools, only with the speed square does the positioning of the wrenches on the speed square allow the strong T-bar to function as a perfect lever for tightening and loosening of the saw nut retaining the saw blade, and
3. The wrenches are recessed and offer no catching surfaces to hinder withdrawal of the tool from, or return of the tool to, pouch, sheath, nail apron, or pocket, unlike the other candidate tools.

Speed squares are often mislaid, lost, or stolen. The invention provides a method for minimizing these problems.

Speed squares contain markings along their edges for determining a number of functions relating to the laying out of rafters, stairs, and the like. If it were possible to incorporate into the design and construction of speed squares additional numerical scales the usefulness of these tools would be enhanced.

SUMMARY OF THE INVENTION

The invention, in one embodiment, consists of a speed square used for laying out work on building materials. Typically, the speed square comprises a three sided triangular flat plate, most often a right triangular flat plate, which is inscribed with units of measure. A T-bar is fitted to, and extends substantially along the length of, an outer edge of one of the sides. The T-bar allows positioning the speed square against the edge of building material to be marked. The T-bar is positioned vertically and is divided equally into two areas by the outer edge of the side to which it is affixed. This is the most common configuration found in commercial speed squares. In some cases the T-bar may be in the shape of an "L" see U.S. Pat. No. 4,573,276. These L-shaped configurations are included within the term "T-bar" as used herein and in the claims.

When the speed square is in the shaped of a right triangle, the T-bar is fitted to the outer edge of one of the 90 degree legs. The T-bar is a rectangular flat bar having a top, bottom, and ends. It is of greater thickness than the thickness of the triangular plate. Located on the top face of the T-bar is at least one nut engaging shaped opening near the end thereof. Preferably there are two nut engaging shaped openings that are located at opposite ends of the T-bar. These openings may be hexagonal shaped openings or any shape to engage ½ inch, 9/16 inch or similar sized nuts or any other size nuts that may be used to retain saw blades of the portable circular saw, variously called worm drive, sidewinder, and contractor saw.

The combination tool is desirably fabricated from aluminum. This is the material of choice since it is structurally strong yet is lightweight. Steel, stainless steel or other materials may be used to fabricate the T-bar. When the speed square is fabricated from a soft material subject to frictional deformation, it is desirable that the said top face of the T-bar be fitted with a reinforcing plate made of steel or similar metal. In the alternative, the speed square may be formed from toughened alloys taken from a class including: Al alloys Al-6.27Zn-25.Mg and Al-5Cr-1.7Zr-1.0Mn to tool steels M2, M10, M20, T1 and T15 (Strandring and Moon) and Al-18.6Si-4.34Cu-0.66Mg alloy (Chen et al.). These and other high strength alloys would avoid the necessity of a reinforcing plate by making the entire speed square with wrenches of same material. Where said reinforcing plate is used it should have a dimension corresponding approximately to the dimension of the said top face of the T-bar. When this feature of construction is used the reinforcing plate is usually fabricated from thin stock, which requires the nut engaging shaped opening extend at least through the reinforcing plate and preferably part way into the said T-bar. When the speed square is aluminum the reinforcing plate is fastened to the bottom of the T-bar using such means as welding, rivets, screws, or adhesives. This general method allows the construction of the square to be of plastic while still providing high strength for the Wrench incorporated therein. Where construction is of plastic, a metal sleeve may be used which Would have the added advantage of providing for better resistance to wear at the pivot points on the ends of the T-bar.

As indicated, speed squares are easily lost, mislaid, or stolen. Theft of tools is currently so common that some contractors factor in stolen tools as a cost of business in each contract. To help solve this problem the invention contemplates each speed square and combination tool speed square would be painted with sharply contrasting colors of paint such as iridescent or daylight fluorescent paint. Such color combinations include:

1. Red vs. green,
2. Orange vs. blue,
3. Violet or purple vs. yellow

In another embodiment of the invention the other of said contrasting colors would show an on-site identification number for said tool in large lettering on one or both sides as well as the top face of the T-bar that projects outward away from the T-square. Said identification number would consist of a combination of two or more alphanumeric characters. Said characters would be selected from among the capital letters of the English alphabet and the Arabic numerals. For clarity, one character from each pair of readily confused characters would not be used. E.g., the capital letter "O" would be used and the numeral "0" would not. With said identification number consisting of 2 alphanumeric characters selected from a set of 34 characters, the available combinations total 1,156. This would make duplication of identification numbers on a job site extremely unlikely. The speed square needs to be recognizable as such at a great distance, even when partly obscured or in non-ideal weather or lighting conditions. Further, the tradesman's own speed square needs to be identifiable as his own at 30 or 40 feet.

THE DRAWINGS

FIG. 1 is a vertical partially cut away front view showing the combination speed square and wrench of the invention.

FIG. 2 is a top view of the combination speed square and wrench of the invention shown in FIG. 1.

FIG. 3 is a partial side view taken across the lines 3—3 of FIG. 1.

In the drawings like parts have like numbers.

PREFERRED EMBODIMENTS

Figure 4:
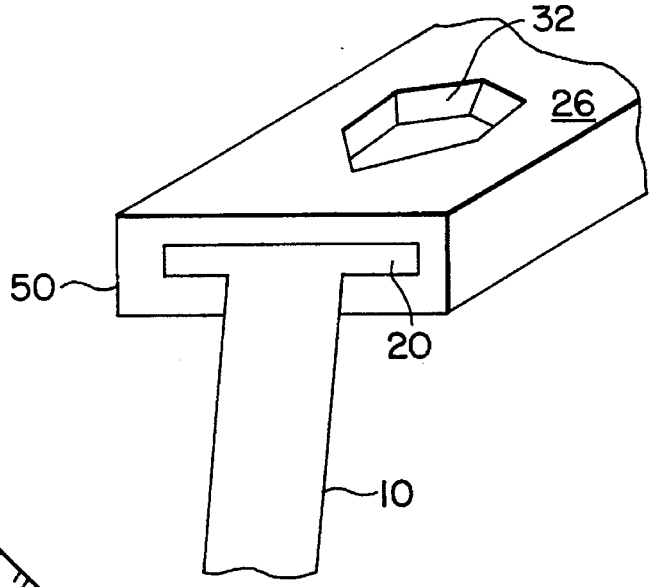
FIG. 4 shows a vertical ¾ view of the top of the speed square with the metal sleeve containing the combination tool affixed to the T-bar.

FIG. 1 shows the combination speed square and wrench of the invention designated generally by the numeral 10. It is in the shape of a right triangle having 90 degree legs 12 and 14. The hypotenuse of the triangle is the third side 16. It is evident that leg 12 is perpendicular to leg 14 whose bottom edge 18 terminates in T-bar 20 which extends the length of leg 14 and is centered with respect thereto.

The bottom 22 of T-bar 20, in a preferred embodiment of the invention, is fitted with a hard metal reinforcing plate having bottom 26 and ends 28 and 30 respectively. Positioned near the ends 28 and 30 are nut engaging openings 32 and 34 that are shown in FIG. 1 to extend part way into the bottom 22 of T-bar 20. The combined thickness of the bottom 22 of T-bar 20 and the reinforcing plate 24 should be sufficient to allow the nut engaging openings 32 and 34 to be of a sufficient depth to accommodate the length of the threaded circular saw shaft and the retaining nut that is fitted thereon (not shown).

As shown in FIG. 2 these openings are hexagonal and are desirably of a different size such as ½ inch and 9/16 inch, which are the most common size nuts used to mount circular saw blades. It is an important concept of the invention that the nut engaging openings 32 and 34 be near the end of the bottom of the T-bar. This positioning allows maximum leverage to be exerted in the tightening and loosening of the nuts to the blade engaging shaft of a circular saw (not shown).

As shown in FIG. 1, the face 36 of the speed square and wrench 10, contains triangular shaped opening 38 and slot 40 which is positioned parallel to the hypotenuse 16. Contained along the outer edge 42 of leg 12 are inch markings 44. Along edge 46 of the hypotenuse 16 are degree markings 66. Markings 48 on one side of slot 40 are numbers used to measure hip and valley cuts. Markings 47, on the other side of said slot are used to measure common rafter cuts. These markings are well known and are described in detail in *The Swanson Speed Square: Swanson's Blue Book of Rafter Lengths & Roof Construction*, previously cited.

Making the speed square out of plastic has the advantage over metal of constituting the speed square as lightweight, inexpensive, and flexible. The disadvantage is that the plastic lacks the high structural strength to withstand the torque generated by incorporation of the said wrench. To retain these advantages and eliminate the disadvantage we propose affixing a metal T-shaped open sleeve 50 to slidably engage with and affix to the T-bar 20 as shown in FIG. 4. This sleeve or slot 50 allows the metal reinforcing plate 26 containing the nut engaging openings 32 and 34 (not shown) to be easily fastened to the T-bar 20 of the plastic speed square 10. Adhesives or other fastening means are used to prevent movement of the metal sleeve 50.

Figure 5:
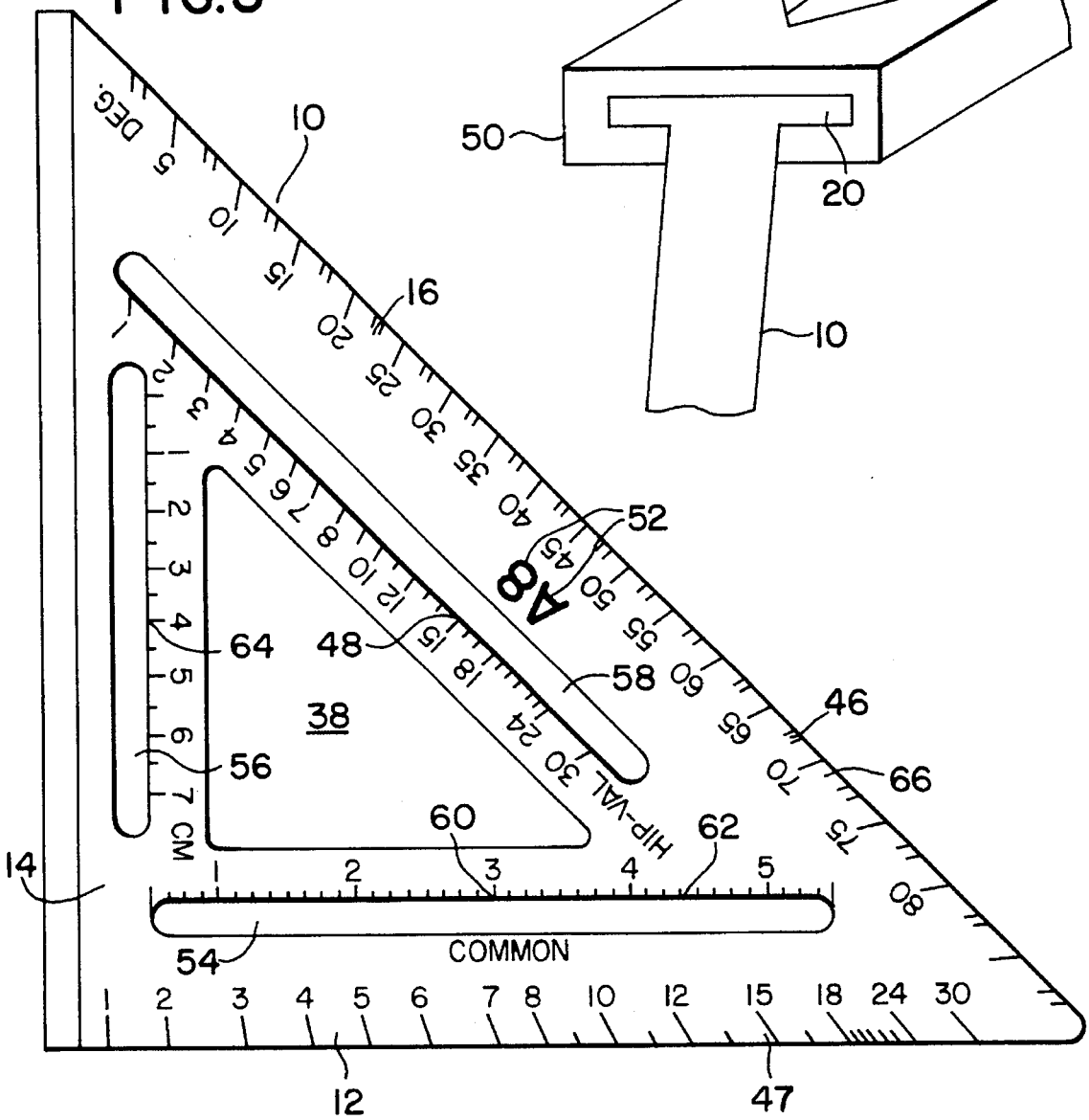
FIG. 5 shows the speed square with a plurality of slots, the edges of which are available for additional scales.

The preferred embodiment illustrated in FIG. 5 involves painting the entire speed square with fluorescent orange paint and adding contrasting on-site-identification numbers 52 in fluorescent blue. Such identification can be read up to nearly 40 feet away and the speed square recognized as such up to 900 feet away.

Another preferred embodiment comprising slots marked with additional scales is depicted in FIG. 5. The speed square 10 is of conventional design, although it may contain the wrench feature of the invention, and contains positioned near the center of legs 12, 14, and hypotenuse 16, slots 54, 56, and 58, respectively. These slots are parallel to the outer edges of legs 12, 14, and the edge of hypotenuse 16. The edge of hypotenuse 16 contains degree markings 66. The outer edge of leg 12 contains common markings. They are dimensioned so as to receive a scribing device such as an awl or a pencil. These slots allow additional scales or numbers to be added to the speed square. This is shown by the inch markings 60 on an edge 62 of slot 54. A metric scale 64 is also added to the edge of slot 56. Slot 58 and markings 48 on hypotenuse 16 are of conventional speed square design. This allows for the fastest most accurate measurements of correct rafter scoring and cutting with the retention of the indicia in inches for square scoring and cutting.

Having thus described our invention it is claimed as follows:

1. An aluminum speed square comprising a triangular flat plate having inscribed along at least one of its sides units of measure; a rectangular T-bar of greater thickness than the triangular flat plate and having top and bottom faces and ends, with the top face being fitted to and extending substantially along the length of an outer edge of the triangular flat plate and with the bottom face containing a toughened aluminum alloy or steel reinforcing plate having a dimension corresponding approximately to the dimension of the bottom of the T-bar; and at least one nut engaging shaped opening extending part way into the bottom of the reinforcing plate and the T-bar near an end which nut engaging shaped opening is sized to receive nuts most commonly used to secure portable circular saw blades.

2. The speed square of claim 1 where there are two nut engaging shaped openings located at opposite ends of the T-bar.

3. The speed square of claim 1 where there are two hexagonal shaped nut engaging openings, located at opposite ends of the T-bar.

4. The speed square of claim 1 where the reinforcing plate is a steel reinforcing plate.

5. The speed square of claim 1 where the reinforcing plate is a sleeve adapted to slidably engage the T-bar.

* * * * *